United States Patent [19]

Breslow et al.

[11] 4,186,927

[45] Feb. 5, 1980

[54] PNEUMATIC PROJECTOR GAME WITH CENTRAL TARGET

[75] Inventors: Jeffrey D. Breslow, Highland Park; Eugene Jaworski, Park Ridge, both of Ill.

[73] Assignee: Marvin Glass & Associates, Chicago, Ill.

[21] Appl. No.: 885,972

[22] Filed: Mar. 13, 1978

[51] Int. Cl.[2] ..... A63B 63/02

[52] U.S. Cl. ..... 273/357; 124/64; 124/41 R; 273/340

[58] Field of Search ..... 273/101, 103, 129 F, 273/95 C, 85 H, 119 B, 85 R; 124/64

[56] References Cited

U.S. PATENT DOCUMENTS

| | | | |
|---|---|---|---|
| 650,633 | 5/1900 | Cooper et al. | 124/64 |
| 943,472 | 12/1909 | Schreiber | 273/119 B |
| 1,033,094 | 7/1912 | Fuda | 124/64 |
| 1,827,885 | 10/1931 | Emenaiser | 273/101 |
| 2,993,297 | 7/1961 | Bednar | 124/64 |
| 3,108,808 | 10/1963 | Peterson | 273/101 |
| 3,599,978 | 8/1971 | Sondergaard | 273/103 |
| 3,834,701 | 9/1974 | Hashimoto | 273/101 |
| 4,079,937 | 3/1978 | Kirsch | 273/119 B |

FOREIGN PATENT DOCUMENTS

| | | | |
|---|---|---|---|
| 636444 | 10/1963 | Belgium | 273/101 |
| 474435 | 9/1952 | Italy | 124/56 |
| 505477 | 12/1954 | Italy | 273/101 |
| 16142 | of 1909 | United Kingdom | 273/8.5 H |

OTHER PUBLICATIONS

Tomy Catalog, p. 15, "Mr. Mouth," rec'd. Feb. 1976.

*Primary Examiner*—Richard C. Pinkham
*Assistant Examiner*—Lawrence E. Anderson
*Attorney, Agent, or Firm*—Mason, Kolehmainen, Rathburn & Wyss

[57] ABSTRACT

A competitive game device employing propulsion means suitable for propelling table tennis balls toward a target suitable for receiving such balls. The target is located in a field having sloping contours for guiding balls which have missed the target to return to a launching position from which such balls may again be propelled toward the target. This invention provides pneumatic podially operated ball propulsion means having actuators spaced from the field in which the target is located and which are movable with respect to each other and the field. Competing players or teams may be allocated sets of colored or otherwise coded balls to be launched and relaunched toward the target. The stations from which a competitor propels the allocated balls at the start of the game may be randomly selected. The relaunching of balls which have missed the target and have returned into one of the launching positions will require the competitor to move to or reach for the actuating means associated with the particular propulsion means to which his ball has been guided after missing the target following the initial launching. Victory is awarded to the competitor who first succeeds in placing into the receiving target a predetermined number of balls allocated to him. It has been found that the game is particularly entertaining when the pneumatic actuators are spaced from and encircle the field and are approximately equidistant from each other so as to require substantial physical locomotion.

2 Claims, 3 Drawing Figures

PNEUMATIC PROJECTOR GAME WITH CENTRAL TARGET

BACKGROUND OF THE INVENTION

This invention relates to game devices and, in particular, to a game device used by competing players to propel table tennis balls or similar projectiles by pneumatic or mechanical means from peripheral locations toward a central receiving target.

Game devices employing mechanical or pneumatic means for propelling projectiles are well known. However, such devices are generally in the nature of a gun or the like, which is aimed and fires a projectile at a target having no particular physical association with the projectile propulsion means. The use of such devices requires somewhat complex and time-consuming procedures for loading the propulsion means and for retrieving the fired projectile. Such devices are not suitable for concurrent repetitive use by a plurality of players. Examples of such devices are shown in Cooper et al U.S. Pat. No. 650,633 issued May 29, 1900; Fuda U.S. Pat. No. 1,033,094 issued July 23, 1912; Bednar U.S. Pat. No. 2,993,297, issued July 25, 1961 and Antonelli Italian Pat. No. 474,435 issued Sept. 23, 1952.

U.S. application Ser. No. 865,735, filed Dec. 29, 1977, assigned to the assignee of the present application, discloses a pneumatically operated game device in which the players are stationary and the actuators are manually operated and which requires participants to manually collect and reload projectiles which missed the receiving target.

By locating the target within a field adapted to guide off-target balls to positions from which they can be relaunched and be requiring podial operation of the actuators and by spacing the actuators so as to require substantial physical locomotion of participants in the game, the present invention seeks to satisfy the continuing need for a competitive game requiring the exercise of some skills and requiring physical locomotion by participants and occasioning incidental physical contacts among participants.

SUMMARY OF THE INVENTION

The present invention relates to a game device providing a receiving target adjacent to or surrounded by a field. Mechanical propulsion means spaced from the target are associated with the field and operative to propel colored sets of table tennis balls or similar projectiles toward the receiving target. The surface of the field surrounding or adjacent to the target is contoured by sloping ridges and valleys which guide off-target balls to a propulsion means. Each propulsion means is pneumatically actuated by podially compressing an air bulb associated with the propulsion means. A plurality of such air bulbs is preferably arranged in a generally circular pattern around the field.

The game may be conducted in accordance with such rules as the participants desire to adopt. A particularly enjoyable mode of playing the game is to allocate colored sets of table tennis balls to each competitor or team, such balls to be launched toward the target and off-target balls to be relaunched toward the target until one of the competitors has propelled all balls allocated to him into the receiving target. The repeated relaunching of off-target balls will require the participants to move around the circularly arranged air bulbs to actuate the particular bulb which operates the propulsion means toward which an off-target ball has been guided by the surface contours of the field surrounding the receiving target.

Other objects, features and advantages of the invention will be apparent from the following detailed description taken in connection with the accompanying drawing.

DETAILED DESCRIPTION OF THE PREFERRED EMBODIMENT

Figure 1:
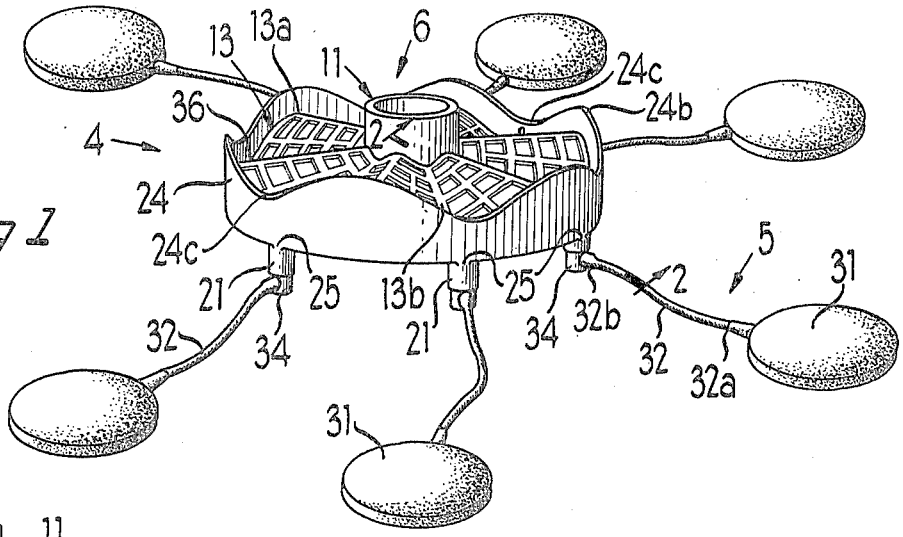
FIG. 1 is a perspective view of the present invention.

The game device of the present invention, generally designated 4, comprises a plurality of pneumatically actuated propulsion means generally designated 5 which are operatively connected to a body, generally designated 6.

The body 6 comprises a generally cup-shaped target 11 having a peripheral wall 11*a* and a bottom wall 11*b* and is suitable for receiving a plurality of table tennis balls 12. At its peripheral wall 11*a*, the target 11 is supported by a field 13 comprising a rigid web composed of a plurality of radial members 14 and interconnecting concentric members 15 defining a plurality of apertures. The interior border 16 of field 13 is adjacent to and integral or connected to peripheral wall 11*a* by adhesive or other means known to those skilled in the art. The exterior border 17 of field 13 is defined adjacent the concentric member 15 most remote from the center. The surface of field 13 is shaped into a plurality of alternating ridges 13*a* and valleys 13*b*, the top of each ridge being defined by a horizontally disposed radial member 15 and the trough of each valley being defined by a radial member 15 which slopes downward from the interior border 16 toward the field's exterior border 17. A cylindrical member 21 extends downwardly at the junction of each vertical member 15 defining the trough of a valley 13*b* and the concentric member 15 forming the exterior border 17 of field 13. The cylinder 21 is open at the top and the bottom and may be molded integrally with or attached to field 13.

Figure 3:
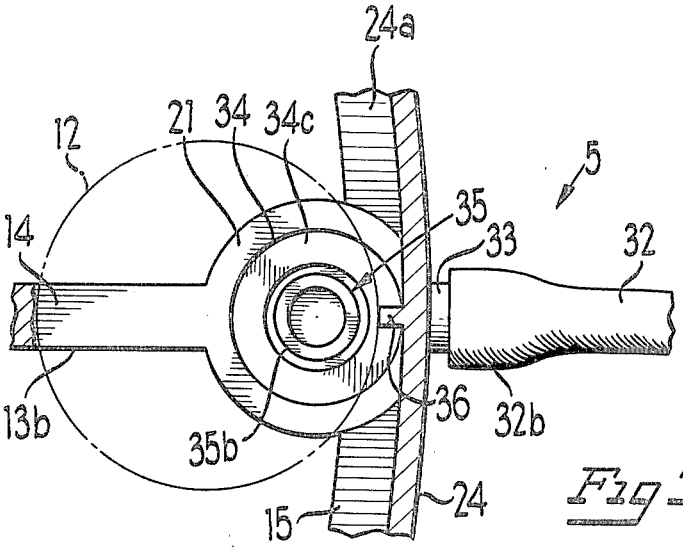
FIG. 3 is a fragmentary, horizontal sectional view taken along line 3—3 of FIG. 2.

An upstanding wall or fence 24 surrounds and extends above the exterior border 17 of field 13. The bottom edge of fence 24 is provided with an interior lip 24*a* shown in FIG. 3. The top edge of fence 24 is formed by a sinuous rim having alternating elevations 24*b* and 24*c* aligned with ridges 13*a* and valleys 13*b* of field 13. In the embodiment shown in the drawing, the wall portions of cylinders 21 are most remote from the center of body 6 and merge into and are flush with fence 24 at areas 25.

Each propulsion means 5 includes a bulb 31 made of rubber, plastic or other suitable flexible material which permits deflation by pressure, preferably caused by the player's foot, and which causes the bulb to resume its original inflated state promptly upon termination of such pressure. A flexible air hose 32 communicates at one end 32*a* with the interior of bulb 31 and has its opposite end 32*b* attached to the input side 33*a* of a nozzle 33. The output portion 33*b* of nozzle 33 fits into a cylindrical chamber 34 through an aperture 34*a* in the side wall of chamber 34 and is held in position by a flange 34*b* inside chamber 34. An annular wall 34*c* at the top of chamber 34 has a central aperture through which the tip of a hollow plunger 35 protrudes. Plunger 35 has a base 35*a*, the circumference of which exceeds that of the aperture in wall 34*c*.

In its normal position, base 35*a* of plunger 35 rests on the mouth of output portion 33*b* of nozzle 33 with a tapered cylindrical wall 35*b* extending upwardly from base 35*a*. Chambers 34 fit into and protrude downward from depending cylinders 21 and are secured against upward displacement by retaining shoulders 36 provided at the inside of fence 24. Chambers 34, thus provide stable support for the body 6 on any suitable generally level horizontal surface 37.

Figure 2:
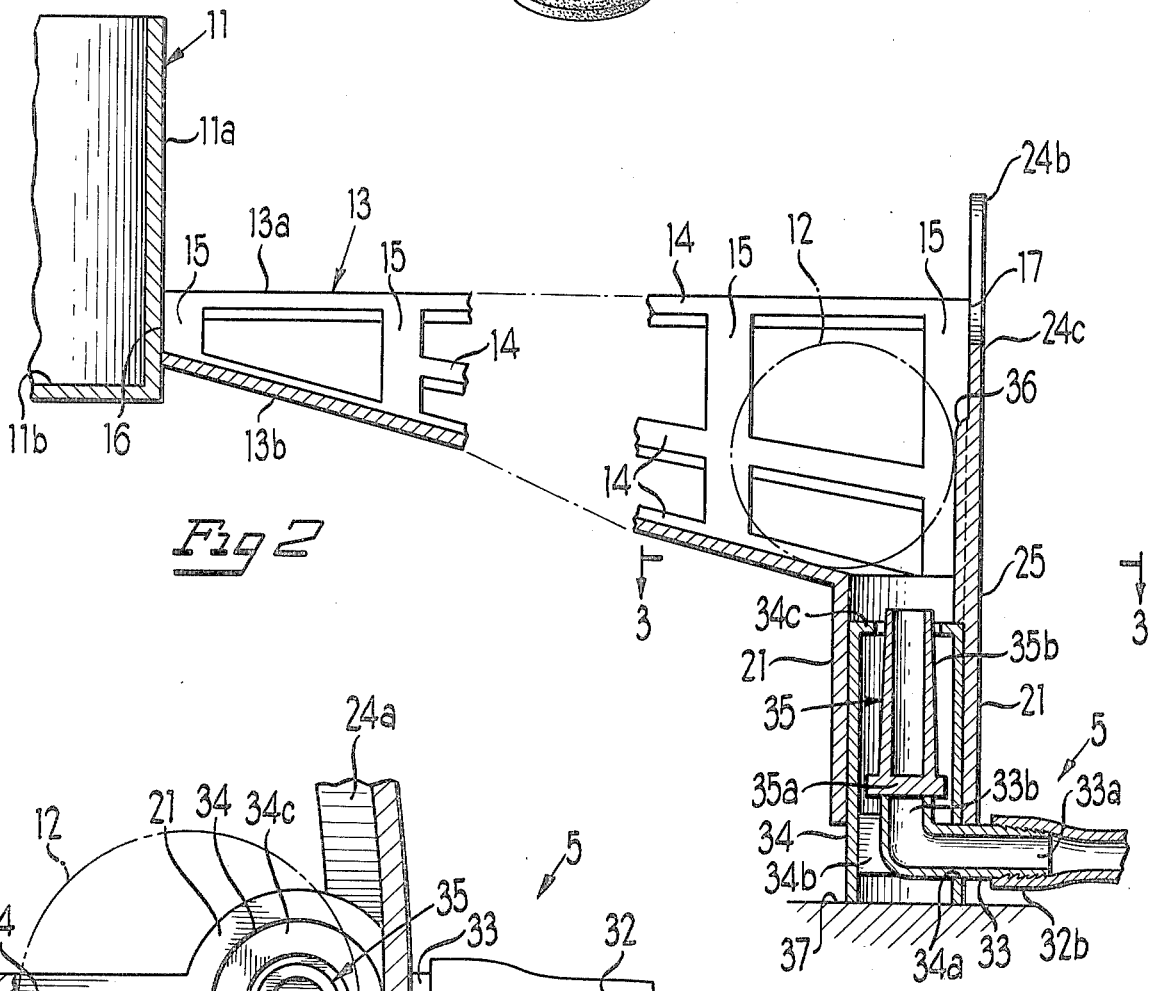
FIG. 2 is a fragmentary vertical sectional view on an enlarged scale taken generally along line 2—2 of FIG. 1.

In operation, table tennis balls 12 placed on field 13 and guided by ridges 13*a* will gravitate towards valleys 13*b* and toward the exterior border 17 of field 13 into the position shown in FIG. 2. Forceful upward movement of plunger 35 will strike ball 12 in such a way as to propel ball 12 above and toward the center of field 13 where it may be either received by target 11 or adjacent portions of field 13. Off-target balls will gravitate toward one of the launching positions as illustrated in FIG. 2.

Each propulsion means 5 is actuated by foot pressure upon an associated air bulb 31 which causes compression of the bulb and a rush of air from the interior of the bulb through air hose 32 and nozzle 33 against bottom wall 35*a* of plunger 35. The impact of the air rush upon bottom wall 35*a* lifts plunger 35 forcefully upwards. The upward movement of plunger 35 is guided by chamber 34 and limited by wall 34*c*. When the momentum imparted to plunger 35 by the rush of air from the interior of bulb 31 is spent, plunger 35 will sink back to its starting position on the end of nozzle 33 as shown in FIG. 2. Release of foot pressure from air bulb 31 will cause the bulb to reassume its original contours and thus reinflate itself. Propulsion means 5 thus capable of frequent repetitive operation.

The game forming the subject matter of the present invention may be played by two or more competitors. Preferably, the number of individuals participating in the game is less than the number of propulsion means 5. Sets of three visually distinguishable, e.g., color coded, table tennis balls are allocated to each competitor for initial launching toward the target by operating one or more of propulsion means 5. Launched balls which are not received by target 11 will return to field 13 and reposition themselves. In practice, the number of off-target balls tends to be large relative to the number of balls received by target 11. Off-target balls may position themselves for relaunching at any one of the plurality of propulsion means. In order to actuate such propulsion means, the competitor has to position himself near the bulb 31 associated with such propulsion means and podially compress such bulb. Rapid movement of players to position themselves at the appropriate air bulb ends to cause obstruction, incidental jostling and collisions among the players which contributes to the enjoyment of the game.

A desirable way of determining the winner is to award victory to the player who first succeeds in propelling his set of balls into target 11. It will be understood that teams of competitors may play the game simultaneously or successively and that different rules or handicaps may be designed by participants to add variety and interest to the game.

The foregoing detailed description has been given for clearness of understanding only and no unnecessary limitations should be understood therefrom as some modifications will be obvious to those skilled in the art.

What is claimed and desired to be secured by Letters Patent of the United States is:

1. A competitive game apparatus, comprising:

a generally circular frame defining a playing area;

a target mounted in the center of the frame;

a plurality of color-coded playing pieces, at least one for each player of the game;

a plurality of selectively operable pneumatic propulsion means radially positioned remote from said target for propelling the playing pieces toward the target, each of said propulsion means including a movable projectile impeller secured to a piston within a slave cylinder and a compressible chamber in fluid communication with said slave cylinder to provide pressurized fluid to the cylinder to drive the impeller into contact with a playing piece thereby launching it toward the target;

wall means surrounding the playing area for containing the playing pieces and for suporting the playing pieces and for supporting the playing pieces in an off axis position relative to the axis of the movable piston to assure launching of the playing pieces toward the target; and support means on the playing area in the form of radially extending ridges and valleys for catching and directing inadvertently launched playing pieces toward at least one of the propulsion means to define which player may operate the selected propulsion means so that selective operation of the propulsion means by the selected player may continue until one player has accurately launched all of the associated playing pieces into the target.

2. The game apparatus of claim 1 wherein said playing pieces are hollow, substantially lightweight spheres.

* * * * *